United States Patent [19]

Janke

[11] 4,372,084

[45] Feb. 8, 1983

[54] DEVICE FOR SEALING A WING OF A WINDOW, A DOOR OR THE LIKE IN RELATION TO A FRAME ASSOCIATED THEREWITH

[75] Inventor: Bernhard Janke, Bindlach, Fed. Rep. of Germany

[73] Assignee: HEF Technische Entwicklung GmbH & Co. KG, Dusseldorf, Fed. Rep. of Germany

[21] Appl. No.: 185,626

[22] Filed: Sep. 10, 1980

[30] Foreign Application Priority Data

Sep. 21, 1979 [DE] Fed. Rep. of Germany ..... 2938193

[51] Int. Cl.[3] ..... E06B 7/16

[52] U.S. Cl. ..... 49/477; 92/31

[58] Field of Search ..... 49/477, 449; 92/31

[56] References Cited

U.S. PATENT DOCUMENTS

| | | | |
|---|---|---|---|
| 608,361 | 8/1898 | Craig | 92/31 |
| 2,953,166 | 9/1960 | Carlson, Jr. | 92/31 |
| 3,302,333 | 2/1967 | Ganzinotti et al. | 49/477 X |
| 3,507,974 | 4/1970 | Clark et al. | 49/477 X |
| 3,745,707 | 7/1973 | Herr | 49/477 X |
| 3,747,275 | 7/1973 | May et al. | 49/477 |
| 3,857,199 | 12/1974 | Frach et al. | 49/477 |

FOREIGN PATENT DOCUMENTS

| | | | |
|---|---|---|---|
| 557228 | 5/1958 | Canada | 92/31 |

*Primary Examiner*—Philip C. Kannan

*Attorney, Agent, or Firm*—Owen, Wickersham & Erickson

[57] ABSTRACT

Doors and windows may be sealed in a particularly efficient manner by arranging on their periphery a flexible sealing tube which is adapted to be expanded by means of a pump which serves to pressurize a liquid with which the tube is filled. The invention is directed to a novel pump which is adapted, independently of the existing temperature, to adjust the desired liquid pressure in the sealing tube. The pump of the invention, while being of compact design, is also adapted for use with windows or doors covering very large openings. This is made possible by the use of an independent supply reservoir for the pressurized liquid, the reservoir being connected to said pump and being also connected to said sealing tube by means of a first valve which is adapted to be operated by a closing device. Between the pump and the sealing tube there is provided a second valve which is adapted to be opened towards the sealing tube.

8 Claims, 7 Drawing Figures

FIG. 1
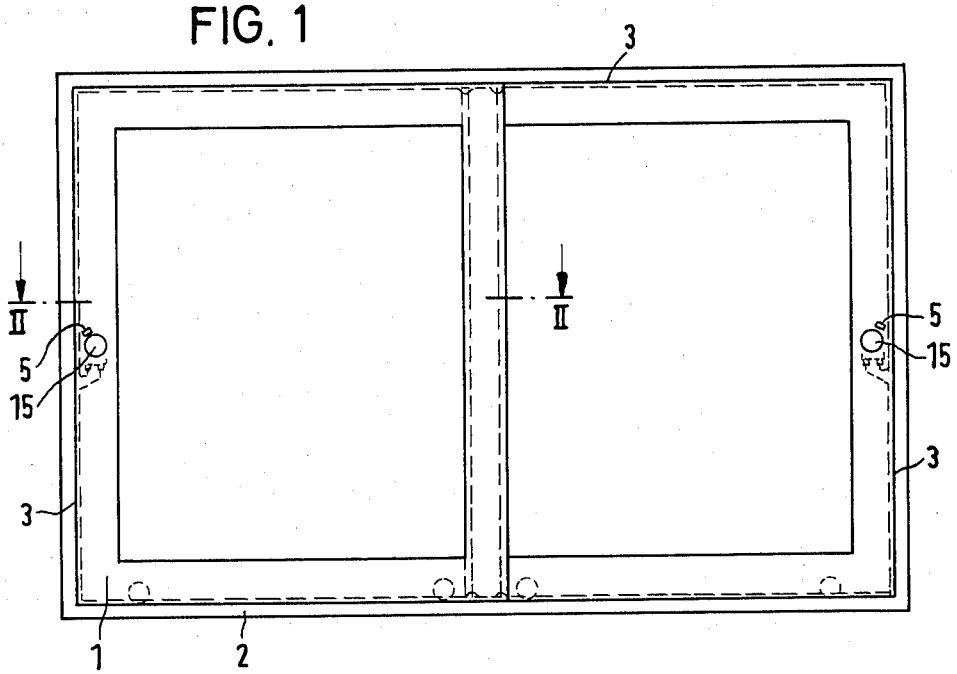
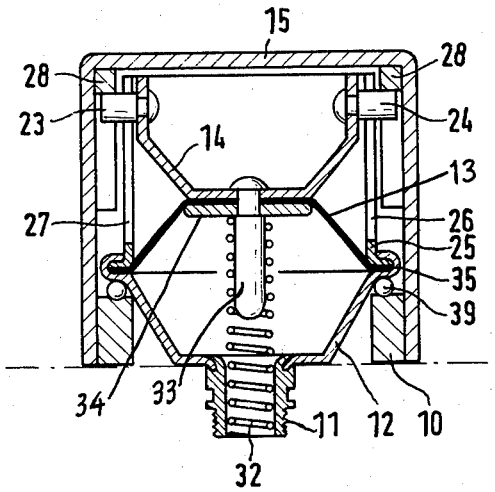
FIG. 3
FIG. 4
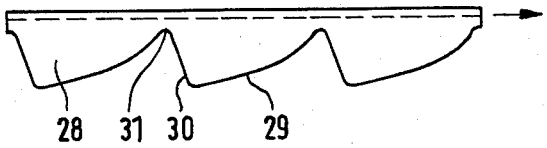

DEVICE FOR SEALING A WING OF A WINDOW, A DOOR OR THE LIKE IN RELATION TO A FRAME ASSOCIATED THEREWITH

BACKGROUND OF THE INVENTION

The present invention relates to a device which is adapted to provide a sealing effect between a window or door wing or the like and a frame associated therewith.

Devices of the aforementioned kind are per se known. Where such devices are used, the gap existing between the wing and the frame is sealed by means of a pressurized tube disposed therebetween. With the window or door in its closed position, said hose is filled with a pressurized liquid by means of a pump so that the tube is forced against the respective sealing surfaces so as to close the gap. Such a device is disclosed, for example, in DE-OS No. 20 44 686. In this known device, the pump is comprised of an elongated tray which is closed by means of a slidably movable plate. This elongated plate is adapted to be slidably moved by means of an inclined cam surface and a roller cooperating with the cam surface. The roller is connected to a scissors-like system of levers which is adapted to be operated either independently or together with the operating handle of the wing. Upon the window being closed, operation of the handle of the wing will cause the system of levers to be actuated, this causing pressure to be exerted on the movable plate of the pump so that it reduces the volume of the pump, this, in turn, causing liquid to be forced into the sealing hose.

Similar devices are disclosed in DE-OS No. 21 40 753 and DE-OS No. 22 13 066. In these latter devices, the pump is accommodated in the frame of the window or door and is adapted to be actuated by the mechanical closing members serving to lock the window.

It is a disadvantage of said known devices that they are not suitable for use with windows and doors covering large areas. This disadvantage results from the fact that, with said known devices, closing the window will cause the pump to perform a single stroke only and that this single stroke is required to force into the sealing tube the entire amount of liquid required for producing said sealing effect. In the case of windows of very large size this means that the pump reservoir is required to have a very large surface area. On the other hand, however, in the window frame space is at a premium. Moreover, in the case of such large-area, single-stroke pumps, a complicated system of levers is required for moving the pressure plate in order uniformly to distribute the required forces throughout the pressure plate and to prevent the pressure plate from being tilted in an undesirable manner.

Another disadvantage of the said known devices resides in the fact that it is impossible to vary the pressure exerted on the sealing tube during closing of the window. The maximum possible pressure is always produced when the window is closed. However, with a given quantity of liquid contained in the pressure tube, the maximum pressure is subjected to considerable variation as a function of temperature. Thus, very high temperatures will result in a high pressure which might cause damage to the tube system. If it is desired to counteract this effect with said conventional devices, the respective system will have to be designed for the maximum pressure to be expected at high temperatures. Therefore, the maximum pressure for sealing will not be attained at normal temperatures. The sealing effect is thus reduced at lower temperatures, i.e. in cold weather, although a particularly reliable sealing effect would be desirable under such weather conditions.

OBJECT OF THE INVENTION

It is a primary object of the present invention to provide a device for sealing a wing of a window, a door or the like in relation to an associated frame which permits the desired liquid pressure in the sealing tube to be adjusted independently of the existing temperature and which is also suitable for use with windows or doors of very large surface area.

SUMMARY OF THE INVENTION

According to the present invention, this object is attained by the provision of a device of the type named which, in contrast to the conventional devices described, does not include a pump which is adapted to perform a single stroke as the window is being closed but which is adapted to permit the sealing tube to be filled by means of a plurality of pump strokes if this should be desired. The quantity of liquid required for expanding the pressurized tube and for thereby sealing the window is withdrawn from a separate supply reservoir. This makes it possible to employ the system of the invention with windows of any desired large size. Another advantage of the inventive device resides in the fact that it may be used on doors or windows on the left side as well as on the right side.

In contrast to the arrangements known thus far, the entire liquid supply is accommodated in a separate supply reservoir rather than in the body of the pump. As a result, the pump body itself may be of relatively small size so that the structural problems are avoided which might be caused by a pump body of large size. As a matter of principle, the supply reservoir can be of any desired shape and may be disposed at any desired point in the window wing.

In order to prevent the liquid forced into the sealing tube from flowing back towards the supply reservoir, the sealing tube is isolated from the pump and the supply reservoir by suitable valves. Upon the window being opened, the valve disposed between the sealing tube and the supply reservoir is opened to permit the pressurized liquid to flow from the sealing tube to the supply reservoir.

In a preferred embodiment of the invention, the valve disposed between the sealing tube and the supply reservoir is a pressure release valve designed to be opened upon the maximum permissible pressure being reached. This means ensures that the maximum permissible pressure in the sealing tube will never be exceeded and that the pressure will adjust itself automatically upon the pump being operated a number of times. Thus, the inventive arrangement ensures optimum sealing of the window or door, this effect being independent of weather conditions, particularly of the ambient temperature.

The separation of the pump and the liquid supply according to the invention affords an additional advantage in that, in the case of liquid losses through leaks, additional liquid need not be supplied to the pump but may simply be introduced into the liquid reservoir. Therefore, it is not necessary to provide any special replenishing means.

In a specific embodiment of the invention, a diaphragm pump is used. In this case there is provided, between the diaphragm pump and the liquid reservoir, a valve which is designed to be opened with the pump chamber being subjected to a negative pressure and to be closed upon the appearance of a positive pressure.

The diaphragm pump preferably includes a pot-like base member which is adapted to be screwed to a valve block. This pot-like base member is closed by a diaphragm at its upper end. Mounted onto the diaphragm are an upper member and a cap provided on this upper member. In order to operate the pump, the user has to exert a force onto the cap so as to move the diaphragm into the pot-like base member. Provided on the inner side of the cap are pegs permitting the cap to be locked with the aid of suitable slots with which the base member is provided.

In another preferred embodiment, it is contemplated to provide sawtooth-shaped cam elements on the inner side of the pump cap. These sawtooth-shaped cam elements rest on pegs which project from an upper member of the pump which is attached to the diaphragm. Upon the cap being rotated, the upper member will be moved downwardly by the cam elements so as to cause liquid to be forced out of the pump. Further rotation of the cap will cause the pegs of said upper member to snap into the downwardly inclined sections of the cam elements, thus causing the diaphragm to rise back from the base member of the pump body and thus to draw in liquid. Thus, rotation of said cap will produce a pumping motion. Preferably, three of the pegs described are provided.

The invention may be carried into practice in a number of ways but certain specific embodiments will now be described by way of example with reference to the accompanying drawings, in which:

BRIEF DESCRIPTION OF THE DRAWINGS

FIG. 1 shows a window including a frame and wings provided with a device according to the invention;

FIG. 3 a section of a first embodiment of a pump employed according to the invention;

FIG. 4 shows the shape of the cam elements employed in the pump of FIG. 3;

DETAILED DESCRIPTION OF THE PREFERRED EMBODIMENTS

Figure 2:
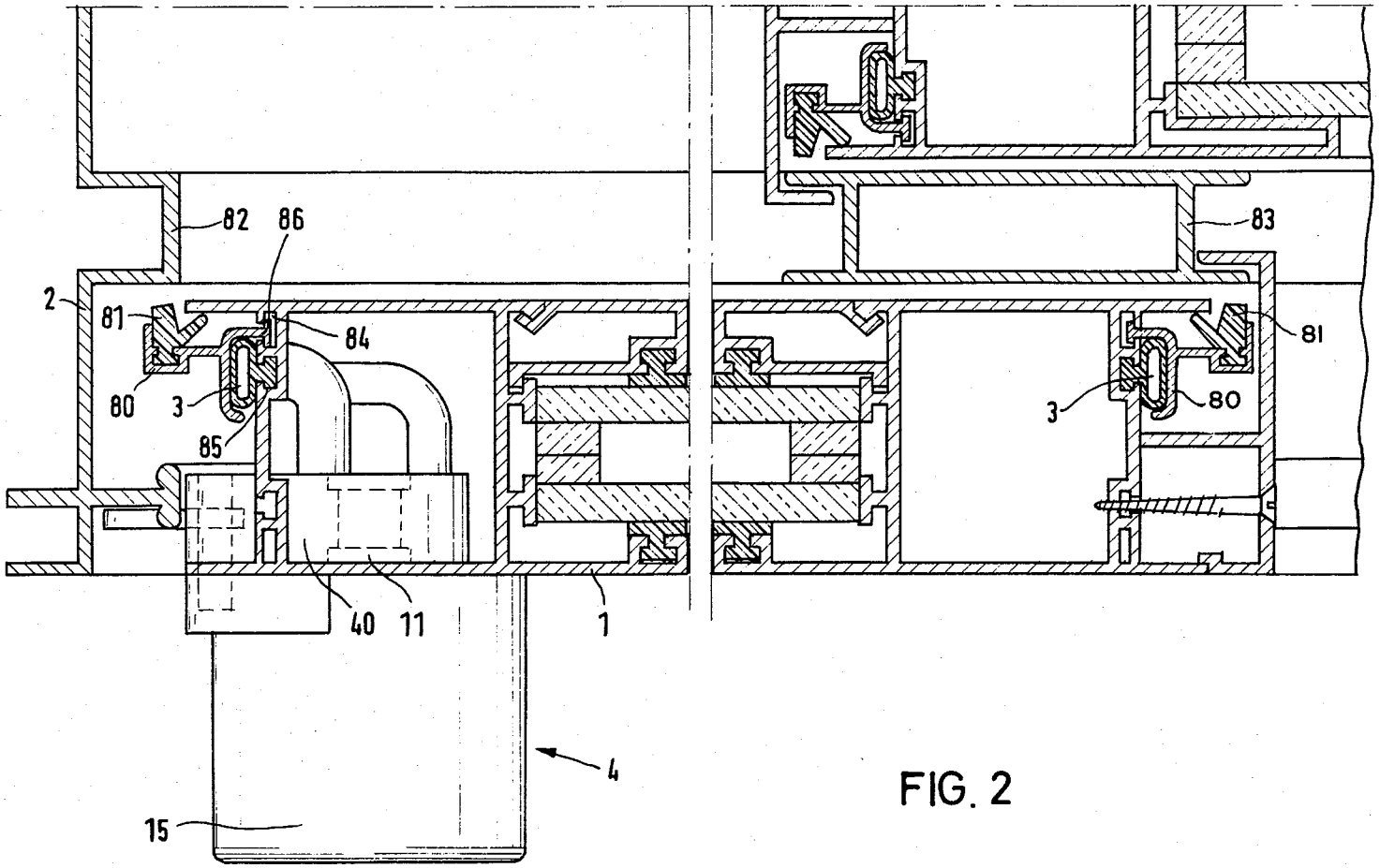
FIG. 2 shows an enlarged fragmentary cross-section along line II—II of FIG. 1.

There is shown in FIG. 1 a window wing 1 mounted in a frame 2. Both the right-hand part and the left-hand part of the window wing are shown as being provided with a cap 15 of a pump 4 (see FIG. 2) and with a lever 5 serving to operate the window closing means so as to indicate that a device of the invention may be employed as desired on the right or left side. The sealing tubes 3 are shown in dash lines.

FIG. 2 shows the fragmentary cross-section of FIG. 1 with the window wing 1 being in its closed position.

A sealing tube 3 having suitable projections is disposed in an undercut groove 85 of the window wing 1. The sealing tube 3 exerts a force on a lever 80 having a joint projection 86 and mounted in another undercut groove 84. Mounted on one end of lever 80 is a rubber seal 81. In addition, the window wing 1 has mounted thereon a pump 4 having a threaded extension 11 which is mounted in a suitable threaded hole of a valve block 40.

Upon pump 4 being operated, liquid is forced into sealing tube 3 so as to expand the sealing tube. This will cause the lever 80 to be pivoted so as to cause rubber seal 81 to be pressed against a central web 82 of the window frame 2 or a frame web 83, respectively, so as to seal the window wing against the frame.

FIG. 3 shows a first embodiment of a pump 4 provided according to the invention. Pump 4 includes a pot-like base member 12 provided with a threaded extension 11. The upper end of the base member 12 is closed by a diaphragm 13 to which an upper member 14 is attached by means of a retaining plate 34 and a pin 33. Projecting outwardly from the upper member 14 are a plurality of pegs (preferably three in number) of which only the pegs 23 and 24 are visible in FIG. 3. These pegs are slidably guided in vertically extending slots provided in a guide sleeve 25. In FIG. 3, of the three slots present only slots 26 and 27 are visible. The upper member 14 and thus also the diaphragm 13 can only be moved in a vertical direction. Thus the diaphragm 13 will not be loaded when the upper member 14 is rotated about its vertical axis. The base member 12 is provided with an internally bent peripheral portion 35 serving to connect the diaphragm 13 with the guide sleeve 25. Mounted on the pegs 23, 24, etc. is the cap 15, which is provided with cam elements 28. The cap 15 extends over the upper and lower members of the pump and is provided with an internally projecting ring 10 serving to hold it in place on the pump. Between the ring 10 and the base member 12 there is disposed adjacent to the peripheral portion 35 a bearing 39 which permits the cap 15 to be rotated in relation to the base and upper members of the pump.

The cam elements 28 are diagrammatically shown in FIG. 4. Each cam element comprises a parabolically curved section 29 which is followed by a steeply inclined section 30. The steeply inclined section 30 is again followed by another parabolically curved section 29. A transition section 31 connecting the parabolically curved section 29 to the steeply inclined section 30 is of arcuate shape for the purpose of accommodating the pegs 23 and 24. According to FIG. 4, the cam edges rise initially relatively steeply, following which their inclination is reduced. This shape takes care of the fact that the initial pressure present in the pressurized tubes is low and will rise continuously upon the pump being caused to perform a number of strokes. Thus, the force required to be imposed to overcome the pressure being built up will be reduced during further rotation of the cap 15 in accordance with the decreasing steepness of the cam edges.

In order to increase the restoring force of the diaphragm 13, there is provided a spring 32 (FIG. 3), the lower end of which is supported within the threaded extension 11 of the base member 12. The upper end of the spring 32 is in sliding contact with the lower end of the pin 33. This pin serves in the manner described to hold the upper member 14 and the diaphragm 13 together.

Figure 5:
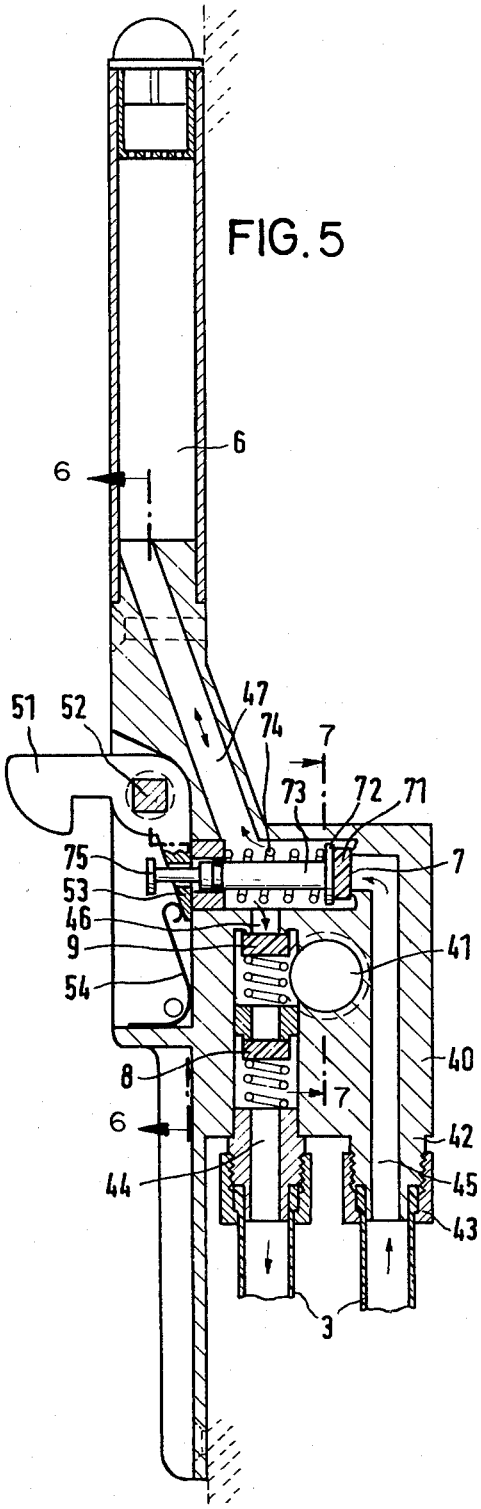
FIG. 5 shows a cross-section of a window wing having accommodated therein a supply reservoir and a valve block.

FIG. 5 is a longitudinal cross-section of a window wing which is provided with a device according to this invention. Accommodated within the window wing is a valve block 40 which is provided with a connecting duct 47 leading to a liquid reservoir 6 which is, for example, mounted on the outer side of the window wing. The valve block 40 is provided with a threaded hole 41 receiving the threaded extension 11 (see FIG. 3) of the diaphragm pump 4. Upon the diaphragm pump being operated so as to expel liquid therefrom, a valve 8 is opened to permit the liquid to flow through an exit duct 44 into the sealing tube 3. Withdrawing the diaphragm of the pump will cause a negative pressure to be produced so as to cause the valve 8 to close. Due to said negative pressure, a valve 9 opens simultaneously so as to permit liquid to flow from the supply reservoir 6 via a passage 46 and the connecting duct 47 to the pump 4.

The opposite end of the sealing tube 3 is connected to a return passage 45. Both the exit duct 44 and the return passage 45 are provided with a connecting section 42 adapted to receive union nuts 43 serving to retain the ends of the sealing tube. The return passage 45 terminates at a valve 7 which is constructed as a pressure release valve which is adapted, upon the maximum permissible pressure being exceeded, to open and thus to permit liquid from the sealing tube 3 to return via the connecting duct 47 to the liquid reservoir 6.

The valve 7 includes a valve seal 71 which cooperates with a suitable valve seat provided at the adjacent end of the return passage 45. A valve disc 72 and a valve spring 74 serve to bias the valve seal 71 towards its seat. The valve spring 74 surrounds a valve stem 73 which terminates in an actuating pin 75. Near the actuating pin 75, the valve stem 73 is provided with an annular groove containing a valve stem sealing ring. The free end of the actuating pin 75 is of larger diameter to form a disc-shaped portion which is adapted to be engaged by an arm 53 of a locking hook 51. The locking hook 51 is pivotally supported by an axle 52 and may be pivoted by means of the actuating lever 5 (see FIGS. 1 and 6). As the window is opened by means of lever 5, the locking hook 51 swung upwardly, this causing the actuating pin 75 of the valve 7 to be pulled towards the left in FIG. 5. This will cause the valve 7 to be opened and thus permit pressurized liquid to flow back from the sealing tube 3 towards the supply reservoir 6. Where such a device is to be mounted on the right side of a window wing, a device is employed which is a mirror image of the device shown in FIG. 5.

Arranged to cooperate with the arm 53 of the locking hook 51 is a leaf spring 54 serving to retain the locking hook 51 in its locking position until the actuating lever 5 is operated.

The valve block 40 is constructed in such a way that the diaphragm pump 4 may be mounted on either side thereof. As shown in the fragmentary cross-section along line VIII—VIII in FIG. 5 represented in FIG. 7, a cover plate 48 is mounted on the side facing away from the pump.

Figure 6:
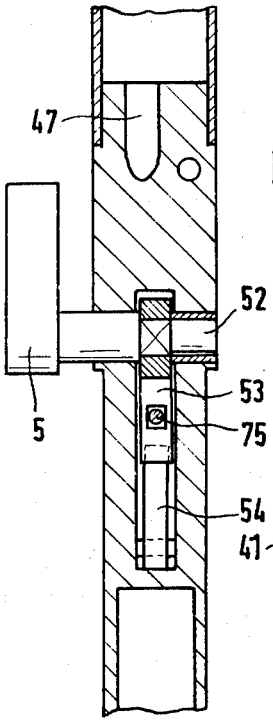
FIG. 6 shows a cross-section along line VII—VII in FIG. 5.
Figure 7:
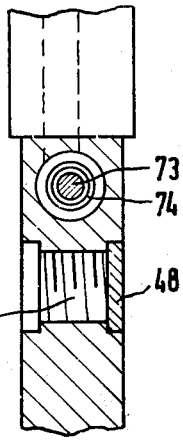
FIG. 7 shows a fragmentary cross-section along line VIII—VIII of FIG. 5.

FIG. 6 shows a fragmentary cross-section along the line VII—VII in FIG. 5. Secured to the operating lever 5 is the locking hook 51 whose arm 53 encompasses the actuating pin 75 of the valve 7. Also shown in FIG. 7 is the leaf spring 54 which biasses the locking hook 51 towards its closing position.

What is claimed is:

1. A device for sealing a wing of a window, a door or the like in relation to a frame associated therewith, said device including a sealing tube which is adapted to be expanded by liquid pressure and including closing means adapted to lock said wing in said frame, said device comprising:

a diaphragm-type pump for producing said liquid pressure, an independent supply reservoir for the liquid to be pressurized, said liquid reservoir being connected to said pump, a first valve for actuation by said closing means connecting said liquid reservoir to said sealing tube, and a second valve between said pump and said sealing tube, and opening towards said sealing tube, said diaphragm-type pump comprising:

a pot-like base member, a diaphragm closing said base member, and an upper member attached to said diaphragm, said upper member supporting a rotatable element, said upper member being provided with pegs and is slidably guided in slots of a guide sleeve, said slots extending at right angles to the plane of said diaphragm, said rotatable element having a plurality of sawtooth-shaped cam elements which rest on said pegs, and being rotatably mounted in relation to said upper member.

2. The device of claim 1, characterized in that said first valve is a pressure release valve adapted to open towards said liquid reservoir.

3. The device of claim 1, characterized in that there is disposed, between said pump and said supply reservoir, a third valve which is adapted to open towards said pump upon a negative pressure becoming effective.

4. The device of claim 1, characterized in that said valves are spring-loaded valves.

5. The device of claim 1, wherein the cam profile of each of said cam elements includes a rising section having a curvature resembling the curvature of a parabola and a relatively steeply descending section.

6. The device of claim 1, wherein said diaphragm is supported in relation to said pot-like base member by a spring.

7. The device of claim 1, characterized in that said connecting portions of said sealing tube, said valves and said supply reservoir are disposed in the interior of said wing, particularly in the rebate thereof.

8. The device of claim 1, characterized in that said pump is mounted on said wing.

* * * * *